United States Patent [19]

Mifune et al.

[11] 4,237,214

[45] Dec. 2, 1980

[54] PROCESS FOR FORMING CONTRASTY IMAGE

[75] Inventors: Hiroyuki Mifune; Shunji Takada; Yoshitaka Akimura; Nobuyuki Tsujino, all of Minami-ashigara, Japan

[73] Assignee: Fuji Photo Film Co., Ltd., Minami-ashigara, Japan

[21] Appl. No.: 54,762

[22] Filed: Jul. 5, 1979

Related U.S. Application Data

[63] Continuation of Ser. No. 861,087, Dec. 15, 1977, abandoned.

[30] Foreign Application Priority Data

Dec. 21, 1976 [JP] Japan ..... 51-154493

[51] Int. Cl.[3] ..... G03C 5/30

[52] U.S. Cl. ..... 430/441; 430/446; 430/264; 430/267; 430/567; 430/599; 430/613; 430/949

[58] Field of Search ..... 430/441, 446, 567, 591, 430/613, 264, 267

[56] References Cited

U.S. PATENT DOCUMENTS

| | | | |
|---|---|---|---|
| 2,131,038 | 9/1938 | Brooker et al. | 96/109 |
| 2,410,690 | 11/1946 | Smith et al. | 96/107 |
| 2,694,716 | 11/1954 | Allen et al. | 96/109 |
| 3,730,727 | 5/1973 | Olivares et al. | 96/95 |
| 3,782,949 | 1/1974 | Olivares et al. | 96/95 |

*Primary Examiner*—Mary F. Downey

*Attorney, Agent, or Firm*—Sughrue, Rothwell, Mion, Zinn and Macpeak

[57] ABSTRACT

A process for forming a very contrasty negative photographic image which comprises developing a photographic light-sensitive material comprising a support having thereon at least one layer of a negative image monodispersed silver halide photographic emulsion comprising substantially surface latent image type silver halide grains, wherein the average grain size of the silver halide grains is 0.7 micron or less, with the silver halide photographic emulsion containing a binder in an amount of 250 g or less per mol of silver halide, and at least one hydrographic colloid layer containing a compound represented by the following general formula (I):

$$R^1NHNHCOR^2 \quad (I)$$

wherein $R^1$ represents an aryl group and $R^2$ represents a hydrogen atom, a phenyl group or an alkyl group having 1 to 3 carbon atoms, in the presence of a compound represented by the following general formula (II) or (III):

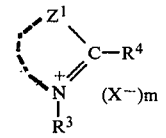

(II)

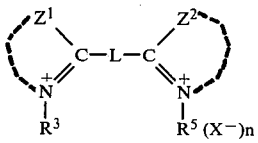

(III)

wherein $Z^1$ and $Z^2$, which may be the same or different, each represents an atomic group necessary to complete a thiazole ring or a selenazole ring; $R^3$ and $R^5$ which may be the same or different, each represents an alkyl group which may be substituted or an alkenyl group which may be substituted; $R^4$ represents a hydrogen atom or an alkyl group which may be substituted; and $R^3$ and $R^4$ may combine to form a ring; L represents a sulfur atom or a divalent hydrocarbon group; $X^-$ represents an acid anion; m represents 0 or 1; n represents 0, 1 or 2 and when an inner salt or inner salts are formed m represents 0 or n represents 0 or 1.

13 Claims, No Drawings

PROCESS FOR FORMING CONTRASTY IMAGE

This is a continuation of application Ser. No. 861,087, filed Dec. 15, 1977, now abandoned.

BACKGROUND OF THE INVENTION

1. Field of the Invention

The present invention relates to a process for forming a photographic image using a silver halide light-sensitive material. More particularly, it relates to a process for forming a very contrasty negative photographic image.

2. Description of the Prior Art

A process which comprises adding hydrazine compounds to silver halide photographic emulsions to obtain a photographic characteristic of a contrasty negative image is described in U.S. Pat. No. 2,419,975. This patent discloses that a very contrasty photographic characteristic of a gamma (γ) of more than 10 is obtained when hydrazine compounds are added to silver chlorobromide emulsions and the emulsions are developed using a developer solution having a pH of as high as 12.8. However, a strongly alkaline developer solution having a pH near 13 is unstable because it is easily oxidized by air and, consequently, it cannot be stored or used for a long period of time. Further, development at such a high pH tends to cause fog.

The supercontrasty photographic characteristic of a very high gamma, for either a negative image or a positive image, is very useful for photographic reproduction of halftone images by means of dot images useful for printing plates or reproduction of line drawing images. In the past, for such a purpose, a process which comprises using silver chlorobromide photographic emulsions having a silver chloride content of more than 50 mol % and preferably more than 75 mol % and developing such with a hydroquinone developer solution having a very low effective sulfite ion concentration (generally, a sulfite ion concentration of less than about 0.1 mol/liter) has been used. However, in this process, the developer solution is very unstable because it has a low sulfite ion concentration and, consequently, the developer solution cannot be stored for more than 3 days. Further, since silver chlorobromide emulsions having a comparatively high silver chloride content are used in this process, a high sensitivity cannot be obtained.

Accordingly, the ability to obtain a supercontrasty photographic characteristic useful for reproduction of dot images or line drawings using high speed emulsions and stable developer solutions has been very much desired.

U.S. Pat. No. 3,386,831 describes a process for stabilizing an emulsion by adding a mono-phenylhydrazide of an aliphatic carboxylic acid into an essentially surface-sensitive photographic silver halide emulsion. The object disclosed in U.S. Pat. No. 3,386,831 is to stabilize the emulsion and such differs from the objects of the present invention.

SUMMARY OF THE INVENTION

A first object of the present invention is to provide a process for forming photographic images having a photographic characteristic of a very contrasty negative image using a stable developer solution.

A second object of the present invention is to provide an image forming process in which a photographic characteristic of a very contrasty negative image with a high sensitivity can be obtained.

A third object of the present invention is to provide a process for forming very contrasty negative photographic images with a low degree of fog.

The above described objects of the present invention are attained with a process for forming a photographic image which comprises developing a photographic light-sensitive material comprising a support having thereon at least one layer of a negative image monodispersed silver halide photographic emulsion comprising substantially surface latent image type silver halide grains, wherein the average grain size of the silver halide grains is 0.7 micron or less, with the silver halide photographic emulsion containing a binder in an amount of 250 g or less per mol of silver halide, and at least one hydrophilic colloid layer containing a compound represented by the following general formula (I):

$$R^1NHNHCOR^2 \qquad (I)$$

wherein $R^1$ represents an aryl group and $R^2$ represents a hydrogen atom, a phenyl group or an alkyl group having 1 to 3 carbon atoms, in the presence of a compound represented by the following general formula (II) or (III):

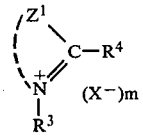

(II)

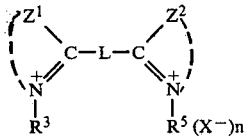

(III)

wherein $Z^1$ and $Z^2$, which may be the same or different, each represents an atomic group necessary to complete a thiazole ring or a selenazole ring; $R^3$ and $R^5$, which may be the same or different, each represents an alkyl group which may be substituted or an alkenyl group which may be substituted; $R^4$ represents a hydrogen atom or an alkyl group which may be substituted; and $R^3$ and $R^4$ may combine to form a ring; L represents a sulfur atom or a divalent hydrocarbon group; $X^-$ represents an acid anion; m represents 0 or 1; n represents 0, 1 or 2 and when an inner salt or inner salts are formed m represents 0 or n represents 0 or 1. When n is 1, a partial inner salt is formed.

DETAILED DESCRIPTION OF THE INVENTION

In the general formula (I) above, $R^1$ represents a monocyclic or bicyclic aryl group. The aryl group may be substituted with one or more substituents which are not electron-attracting, such as alkyl groups having 1 to 20 carbon atoms (which may be straight or branched chained), aralkyl groups having 1 to 3 carbon atoms in the alkyl moiety thereof (which may be straight or branched chained), alkoxy groups having 1 to 20 carbon atoms (which may be staright or branched chained), amino groups which are mono- or di-substituted with alkyl groups having 1 to 20 carbon atoms (which may be straight or branched chained), aliphatic acylamino groups having 2 to 21 carbon atoms or aromatic acylamino groups, etc.

$R^2$ represents a hydrogen atom, an alkyl group having 1 to 3 carbon atoms which may be straight or branched chained or a phenyl group. It is preferred for the alkyl group to be unsubstituted. The phenyl group may be substituted with one or more substituents which preferably are electron attracting groups such as a halogen atom (e.g., a chlorine atom or a bromine atom, etc.), a cyano group, a trifluoromethyl group, a carboxyl group or a sulfo group, etc.

Examples of suitable substituents represented by $R^1$ include a phenyl group, an α-naphthyl group, a β-naphthyl group, a p-tolyl group, an m-tolyl group, an o-tolyl group, a p-methoxyphenyl group, an m-methoxyphenyl group, a p-dimethylaminophenyl group, a p-diethylaminophenyl group, a p-(acetylamino)phenyl group, a p-(caproylamino)phenyl group, a p-(benzoylamino)phenyl group and a p-benzylphenyl group, etc.

Examples of suitable substituents represented by $R^2$ other than a hydrogen atom include a methyl group, an ethyl group, an n-propyl group, an isopropyl group, a phenyl group, a 4-chlorophenyl group, a 4-bromophenyl group, a 3-chlorophenyl group, a 4-cyanophenyl group, a 4-carboxyphenyl group, a 4-sulfophenyl group, a 3,5-dichlorophenyl group and a 2,5-dichlorophenyl group.

Monocyclic aryl groups are preferred for $R^1$ and an unsubstituted phenyl group and a tolyl group are particularly preferred for $R^1$.

A hydrogen atom, a methyl group and phenyl groups which may be substituted are preferred for $R^2$. A hydrogen atom is particularly preferred for $R^2$.

The thiazole ring or the selenazole ring completed by $Z^1$ or $Z^2$ in the general formula (II) or (III) may be substituted with one or more substituents at positions other than the 2- and 3-positions thereof, and may be fused with another carbocyclic ring having 5 to 7 carbon atoms. Examples of substituents include an alkyl group having 18 or less carbon atoms, a straight chain, branched chain or cyclic alkoxy group having 18 or less carbon atoms and a monocyclic or bicyclic aryl group. Examples of rings which may be fused to $Z^1$ and $Z^2$ include a benzene ring, a cyclohexene ring, an azulene ring and a cycloheptene ring.

Examples of fused thiazole rings completed by $Z^1$ or $Z^2$ include a benzothiazole ring, a naphtho[1,2-α]thiazole ring, a naphtho[2,1-α]thiazole ring, a naphtho[2,3-α]thiazole ring, a thiazolo[4,5-α]azulene ring, a tetrahydrobenzothiazole ring, a dihydronaphtho[1,2-α]thiazole ring, a dihydronaphtho[2,1-α]thiazole ring, etc. An example of typical fused selenazole rings completed by $Z^1$ or $Z^2$ is a benzoselenazole ring. The carbon atoms of these fused rings may be substituted with one or more substituents.

Examples of suitable substituents which can be present on these rings include one or more of a halogen atom (for example, a chlorine atom, a bromine atom, etc.), a straight chain, branched chain or cyclic alkyl group having 1 to 18 carbon atoms (for example, a methyl group, an ethyl group, a heptadecyl group, etc.), a straight chain or branched chain alkoxy group having 1 to 18 carbon atoms (for example, a methoxy group, an ethoxy group, a heptadecyloxy group, etc.), a straight chain or branched chain alkoxycarbonyl group having 2 to 18 carbon atoms (for example, a methoxycarbonyl group, an ethoxycarbonyl group, etc.), a carboxy group, a cyano group, a trifluoromethyl group, a nitro group, a sulfo group, a phenyl group which may be substituted with a halogen atom such as a bromine atom, a chlorine atom, etc., an acyl group having 18 or less carbon atoms (for example, a straight chain or branched chain alkylcarbonyl group such as an acetyl group, a propionyl group, etc., a straight chain or branched chain alkylsulfonyl group such as a methylsulfonyl group, etc.), a sulfamoyl group, a sulfamoyl group substituted with one or two straight chain, branched chain or cyclic alkyl groups or aryl groups (for example, a methylsulfamoyl group, a benzenesulfamoyl group, etc.), a carbamoyl group (for example, a methylcarbamoyl group, a dimethylcarbamoyl group, an ethylcarbamoyl group, a phenylcarbamoyl group, etc.), a hydroxy group, a straight chain or branched chain alkylthio group having 18 or less carbon atoms, and the like.

Specific examples of suitable thiazole and selenazole rings completed by $Z^1$ or $Z^2$ include a thiazole ring, a 4-methoxythiazole ring, a 4-methylthiazole ring, a 5-methylthiazole ring, a 4,5-dimethylthiazole ring, a 4-ethyl-5-methoxythiazole ring, a 4-methyl-5-ethoxythiazole ring, a 4-ethoxy-5-methylthiazole ring, a 4-phenylthiazole ring, a 5-phenylthiazole ring, a 4-(p-sulfophenyl)thiazole ring, 5-(p-sulfophenyl)thiazole ring, a 4,5-di-(p-sulfophenyl)thiazole ring, a benzothiazole ring, a 4-chlorobenzothiazole ring, a 5-chlorobenzothiazole ring, a 6-chlorobenzothiazole ring, a 5-methylbenzothiazole ring, a 6-methylbenzothiazole ring, a 5-bromobenzothiazole ring, a 5-carboxybenzothiazole ring, a 5-ethoxycarbonylbenzothiazole ring, a 5-hydroxybenzothiazole ring, a 5-phenylbenzothiazole ring, a 4-methoxybenzothiazole ring, a 5-methoxybenzothiazole ring, a 6-methoxybenzothiazole ring, a 5-ethoxybenzothiazole ring, a tetrahydrobenzothiazole ring, a 5,6-dimethoxybenzothiazole ring, a 5,6-dioxymethylenebenzothiazole ring, a 6-ethoxy-5-methylbenzothiazole ring, a 5-phenethylbenzothiazole ring, a naphtho[1,2-α]thiazole ring, a naphtho[2,1-α]thiazole ring, a naphtho[2,3-α]thiazole ring, a 5-methoxynaphtho[1,2-α]thiazole ring, a 8-methoxynaphtho[2,1-α]thiazole ring, a 7-methoxynaphtho[2,1-α]thiazole ring, an 8,9-dihydronaphtho[1,2-α]thiazle ring, a 4,5-dihydronaphtho[2,1-α]thiazole ring, a 4-methylselenazole ring, a 4-phenylselenazole ring, a benzoselenazole ring, a 5-chlorobenzoselenazole ring, a 5-methoxybenzoselenazole ring, a 5-methylbenzoselenazole ring, a tetrahydrobenzoselenazole ring, a naphtho[1,2-α]selenazole ring, a naphtho[2,1-α]selenazole ring, etc.

The alkyl group or the alkenyl group represented by $R^3$ or $R^5$ is preferably an alkyl or alkenyl group having 1 to 18 carbon atoms which may be straight chained, branched chained or cyclic and may be substituted.

Examples of substituents which can be present on the alkyl and alkenyl group for $R^3$ and $R^5$ include one or more of a halogen atom (for example, a chlorine atom, a bromine atom, etc.), a cyano group, a sulfo group, a carboxy group, a phospho group, a straight chain or branched chain alkoxycarbonyl group having 18 or less carbon atoms (for example, an ethoxycarbonyl group, a 3-benzothiazolyl methoxycarbonyl group, etc.), a straight chain or branched chain acyloxy group having 18 or less carbon atoms (for example, an acetoxy group, a 3-benzothiazolylacetoxy group, etc.), a straight chain or branched chain alkoxy group having 18 or less carbon atoms (for example, a methoxy group, an ethoxy group, etc.), a substituted straight chain or branched chain alkoxy group (for example, a sulfoalkoxy group such as a sulfoethoxy group, etc., a sulfoalkoxyalkoxy group such as a sulfoethoxyethoxy group, etc., an alkoxy group substituted with a heterocyclic group such as a 3-benzothiazolylmethoxy group, etc.), a hydroxy group, an unsubstituted or substituted straight chain or branched chain alkylthio group (for example, a methylthio group, a 3-benzothiazolylmethylthio group, etc.), a carbamoyl group, a substituted carbamoyl group (for example, a dimethylcarbamoyl group, an ethylcarbamoyl group, a phenylcarbamoyl group, etc.), a sulfamoyl group, a substituted sulfamoyl group (for example, a dimethylsulfamoyl group, an ethylsulfamoyl group, a phenylsulfamoyl group, etc.), a monocyclic or bicyclic aryl group (for example, a phenyl group, a naphthyl group, etc.), a substituted aryl group (for example, a tolyl group, a 4-(3-benzothiazolylmethyl)phenyl group etc.), a 5- or 6-membered heterocyclic group containing one or more nitrogen, oxygen and sulfur atoms as hetero atoms (for example, a 3-thiazolyl group, a 3-benzothiazolyl group, a 6-methoxy-3-benzothiazolyl group, etc.), and the like.

Of the alkyl groups substituted with a heterocyclic group described above for $R^3$ and $R^5$, a group represented by the following general formula (IV) is suitable.

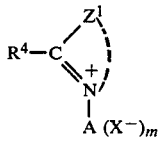

(IV)

wherein $Z^1$, $R^4$, $X^-$ and m each has the same meaning as defined in the general formula (II); and A represents an alkylene group having 18 or less carbon atoms which may be straight or branched chained and may be substituted.

Suitable examples of suitable alkylene groups represented by A include a methylene group, a decylene group, a dodecylene group, etc.

Specific examples of suitable alkyl groups represented by $R^3$ or $R^5$ include a methyl group, an ethyl group, an n-propyl group, an isopropyl group, an n-butyl group, a 2-chloroethyl group, a 2-cyanoethyl group, a 2-sulfoethyl group, a 3-sulfopropyl group, a 4-sulfobutyl group, a 3-sulfobutyl group, a 2-hydroxy-3-sulfopropyl group, a 2-chloro-3-sulfopropyl group, a carboxymethyl group, a 2-carboxyethyl group, a 2-phosphoethyl group, a 3-phosphopropyl group, a methoxycarbonylmethyl group, an acetoxymethyl group, a methoxymethyl group, a 2-ethoxyethyl group, a 2-(3-sulfopropoxy)ethyl group, a 2-[2-(3-sulfopropoxy)ethoxy]ethyl group, a 2-hydroxyethyl group, a 3-hydroxypropyl group, a benzyl group, a phenethyl group and a 6-(3-benzothiazolyl)hexyl group. Specific examples of suitable alkenyl groups represented by $R^3$ include an allyl group, a 2-butenyl group, a 4-butenyl group, a 2-heptenyl group, etc.

The alkyl group represented by $R^4$ is preferably an alkyl group having 1 to 6 carbon atoms which may be straight or branched chained and may be substituted. Examples of suitable substituents for $R^4$ include one or more of a halogen atom (for example, a chlorine atom, etc.), a hydroxy group, a straight chain or branched chain alkoxy group having 1 to 5 carbon atoms (for example, a methoxy group, etc.), a straight chain or branched chain alkylthio group having 1 to 5 carbon atoms (for example, a methylthio group, etc.), a carboxy group, a sulfo group, a straight chain or branched chain alkoxycarbonyl group having 2 to 5 carbon atoms, a straight chain or branched chain alkylcarbonyloxy group (for example, an acetoxy group, etc.), and the like.

Specific examples of suitable alkyl groups represented by $R^4$ include a methyl group, an ethyl group, a propyl group, a butyl group, a methoxymethyl group, an acetoxymethyl group, a methoxycarbonylmethyl group, a chloromethyl group, a bromomethyl group, a 2-chloroethyl group, a 2-bromoethyl group, a hydroxyethyl group, a methylthiomethyl group, a methylthioethyl group, and a carboxyethylthiomethyl group.

Suitable rings formed by combination of $R^3$ and $R^4$ are preferably 5- or 6-membered rings and they may contain an oxygen atom or a sulfur atom other than the nitrogen atom to which $R^3$ is bonded.

Specific examples of suitable rings formed by the combination of $R^3$ and $R^4$ include a pyrroline ring, a thiazoline ring and a tetrahydropyridine ring.

The acid anion represented by $X^-$ may be an inorganic acid anion or an organic acid anion. Specific examples are inorganic acid anions, for example, a chlorine ion, a bromine ion, an iodine ion, a sulfate ion, a nitrate ion, a perchlorate ion, etc., and organic acid anions, for example, a methylsulfate ion, a p-toluenesulfonate ion, etc.

When a compound represented by the general formula (II) or a group represented by the general formula (III) forms an inner salt, an acid anion as a counter ion is not present necessarily outside the molecule and thus m or n is 0.

The divalent hydrocarbon group represented by L in the general formula (III) is preferably a divalent hydrocarbon group having 1 to 12 carbon atoms, may contain a saturated or unsaturated ring (such as a benzene ring), may be straight or branched chained and may be substituted. Examples of suitable substituents for L include one or more of a hydroxy group, a chlorine atom and a phenyl group. Suitable divalent hydrocarbon groups also include those hydrocarbon groups in which the carbon chain is interrupted with an oxygen atom or a sulfur atom. Specific examples of suitable divalent hydrocarbon groups represented by L include an ethylene group, a butylene group, a 1,4-phenylene group, $-CH_2CH_2-O-CH_2CH_2-$, $-CH_2CH_2-S-CH_2CH_2-$, etc.

Of the compounds represented by the general formula (II), a particularly preferred compound is represented by the following general formula (IIa):

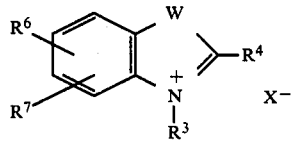

(IIa)

In the above formula (IIa) W represents a sulfur atom or a selenium atom. W is preferably a sulfur atom. $R^3$, $R^4$ and $X^-$ each has the same meaning as defined in the general formula (II). $R^6$ and $R^7$, which may be the same or different, each represents a hydrogen atom, a halogen atom (for example, a chlorine atom, a bromine atom, etc.), a nitro group, a cyano group, a sulfo group, a carboxy group, a straight chair or branched chain alkoxycarbonyl group having 2 to 18 carbon atoms (for example, an ethoxycarbonyl group, a butoxycarbonyl group, etc.), a straight chain or branched chain acyl group having 2 to 18 carbon atoms (for example, an acetyl group, etc.), a straight chain, branched chain or cyclic alkyl group having 1 to 18 carbon atoms (for example, a methyl group, an ethyl group, an n-butyl group, a heptyl group, a decyl group, etc.), a straight chain or branched chain alkoxy group having 1 to 18 carbon atoms (for example, a methoxy group, a butoxy group, a heptadecyloxy group, etc.), a straight chain or branched chain alkylthio group having 1 to 18 carbon atoms (for example, a methylthio group, a butylthio group, etc.), a straight chain or branched chain acylamino group having 2 to 18 carbon atoms (for example, an acetylamino group, a capryloylamino group, heptadecanoylamino group, etc.), a hydroxy group, a phenyl group which may be substituted with one or more of a halogen atom (for example, a chlorine atom, a bromine atom, etc.) and an alkyl group having 1 to 3 carbon atoms (for example, a methyl group, an ethyl group, a propyl group, etc.) or an aralkyl group having 7 to 12 total carbon atoms and having a straight chain or branched chain alkyl moiety (for example, a benzyl group, a phenethyl group, etc.). Further, $R^6$ and $R^7$ may combine together to form a group, for example, a methylene dioxy group, an ethylene dioxy group, etc., and $R^6$ and $R^7$ may combine together to form an aromatic ring such as a benzene ring. A compound represented by the general formula (IIa) in which $R^4$ is a hydrogen atom is particularly preferred.

The silver halide grains having an average particle size of 0.7 micron or less which are used in the silver halide emulsion layer having a binder in an amount of 250 g or less per mol of silver halide according to the present invention are substantially surface latent image type silver halide grains. In other words, the silver halide grains are not of the substantially internal latent image type. The term "substantially surface latent image type" is used in the description of the present invention to describe the situation in which the sensitivity resulting from the following surface development (A) is higher than that resulting from the following internal development (B) when the emulsion is subjected to surface development (A) or internal development (B) after exposure to light for 1 to 0.01 second, wherein the sensitivity is defined by the following relationship:

$$S=100/Eh$$

where S represents the sensitivity and Eh represents the amount of exposure necessary to obtain an average density: $\frac{1}{2}(D_{max}+D_{min})$, between the maximum density ($D_{max}$) and the minimum density ($D_{min}$).

Surface Development (A)

The emulsion is developed at 20° C. for 10 minutes in a developer solution having the following composition.

| | |
|---|---|
| N-Methyl-p-aminophenol (hemisulfate) | 2.5 g |
| Ascorbic Acid | 10 g |
| Sodium Metaborate (tetrahydrate) | 35 g |
| Potassium Bromide | 1 g |
| Water to make | 1 l |

Internal Development (B)

The emulsion is processed at about 20° C. for 10 minutes in a bleaching solution containing 3 g/liter of potassium ferricyanide and 0.0125 g/liter of phenosafranine, washed with water for 10 minutes and developed at 20° C. for 10 minutes in a developer solution having the following composition.

| | |
|---|---|
| N-Methyl-p-aminophenol (hemisulfate) | 2.5 g |
| Ascorbic Acid | 10 g |
| Sodium Metaborate (tetrahydrate) | 35 g |
| Potassium Bromide | 1 g |
| Sodium Thiosulfate | 3 g |
| Water to make | 1 l |

If the emulsions used in the present invention are not substantially surface latent image type emulsions, a positive image tends to be obtained as well as a negative image.

The average grain size of the substantially surface latent image type silver halide grains used in the silver halide emulsion layer having a binder in an amount of 250 g or less per mol of silver halide according to the present invention should not be larger than 0.7 micron. The term "average grain size" is well known and is generally used by persons skilled in the silver halide photographic field. The grain size means the diameter of the grains which are spherical or nearly spherical. Where the grains are cubic, the grain size means the length of the edge $\times\sqrt{4/\pi}$. The average is calculated as an algebraic average or a geometric average based on the projected area of the grains. Details of the calculations of the average grain size are described in C. E. K. Mees and T. H. James, *The Theory of the Photographic Process*, 3rd Ed., pages 36–43, Macmillan Co., (1966).

In the emulsions of the present invention, if the average grain size exceeds 0.7μ,a very high contrast of a γ of more than 8 cannot be obtained, when the emulsions are processed with a stable developer solution containing sulfite ions in an amount of 0.1 mol/liter or more. It is further preferred for the average grain size of the silver halide grains in the emulsions of the present invention to be less than 0.4μ. A characteristic of the light-sensitive material of the present invention is to provide a high sensitivity in spite of a small average grain size according to the process for forming images. It is necessary for 90% by weight or on a number basis based on the total silver halide grains to have a grain size in the range of ±40% of the average grain size (generally, such an emulsion is called a monodispersed emulsion).

The silver halide which is used in this invention can be any of silver chloride, silver bromide, silver chlorobromide, silver iodobromide and silver iodochlorobromide. With silver iodobromide or silver iodochlorobromide, it is preferred for the silver iodide content to not exceed about 10 mol %, particularly not exceed 6 mol %. According to the present invention, it is easy to obtain a higher sensitivity than in case of using a prior art lith-type supercontrasty light-sensitive material, since silver bromide, silver iodobromide and silver chlorobromide having a higher silver bromide content or silver iodochlorobromide having a higher silver bromide content can be used.

When the silver halide contains silver chloride the silver chloride content preferably does not exceed about 80 mol %, particularly does not exceed 50 mol %, of the total silver halide.

The photographic emulsion layer composed of substantially surface latent image type silver halide grains having an average grain size of 0.7 micron or less used in the present invention should not contain more than 250 g of binder per mol of silver halide. If the emulsion contains a binder in an amount of more than 250 g per mol of silver halide, it is not possible to obtain a contrasty tone and, particularly, to obtain an extremely contrasty photographic characteristic which is an object of the present invention. Although a general tendency for photographic emulsions is that the lower the amount of the binder in the emulsions is, the more contrasty the tone obtained is, such a tendency is an effect based on the amount of silver halide present in the emulsion layer per unit thickness and unit area. The influence of the amount of silver halide in the present invention is different from that in known cases, and the influence upon gradation changes greatly in an amount near the above-described limit. The effect of the present invention is only obtained when the average grain size does not exceed 0.7$\mu$ and the amount of silver halide in the emulsion is high.

Although gelatin is generally and advantageously used as the binder or protective colloid for the photographic emulsions of the present invention, other hydrophilic colloids may also be used in the present invention. For example, it is possible to use proteins such as gelatin derivatives, graft polymers of gelain with other high molecular weight materials, albumin or casein, etc., cellulose derivatives such as hydroxyethylcellulose, carboxymethylcellulose or cellulose sulfates, etc., saccharide derivatives such as sodium alginate or starch derivatives, etc., and synthetic hydrophilic high molecular weight materials such as homo- or copolymers such as polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole, etc.

Not only lime processed gelatin but also acid treated gelatin may be used as the gelatin. Further, gelatin hydrolysis products or enzymatic gelatin decomposition products may be used. Those gelatin derivatives which are produced by reacting gelatin with various compounds such as acid halides, acid anhydrides, isocyanates, bromoacetic acid, alkanesultones, vinylsulfonamides, maleinimide compounds, polyalkylene oxides or epoxy compounds, etc., may be used. Examples of these gelatin derivatives are described in, for example, U.S. Pat. Nos. 3,614,928, 3,132,945, 3,186,846 and No. 3,312,553, British Pat. Nos. 861,414, 1,033,189 and No. 1,005,784 and Japanese Pat. No. 26845/1967.

As the above-described gelatin graft polymers, it is possible to use those produced by grafting gelatin with homo- or copolymers of vinyl monomers such as acrylic acid, methacrylic acid, the esters thereof, the amides thereof, acrylonitrile or styrene, etc. Graft polymers prepared from polymers which are compatible with gelatin, such as polymers of acrylic acid, methacrylic acid, acrylamide, methacrylamide or hydroxyalkyl methacrylates, etc., are particularly preferred. Examples of graft polymers are described in U.S. Pat. Nos. 2,763,625, 2,831,767 and No. 2,956,884, etc. Typical synthetic hydrophilic high molecular weight materials are those described in German patent application (OLS) No. 2,312,708, U.S. Pat. No. 3,620,751 and No. 3,879,205 and Japanese Pat. No. 7561/1968.

Although the photographic light-sensitive material according to the present invention is characterized as having at least one photographic emulsion layer possessing the above described characteristics, the photographic material can optionally include one or more silver halide photographic emulsion layers other than the photographic emulsion layer possessing the above-described characteristics. In such other photographic emulsion layers the average grain size of the silver halide can be more than 0.7 micron, the binder can be present in an amount more than 250 g per mol of the silver halide and the silver halide grains can be those which are not of the substantially surface latent image type. Further, these photographic emulsion layers can be chemically sensitized in any known manner.

The relationship of position of the photographic emulsion layer which fulfills the requirements according to the present invention and the other photographic emulsion layers is not particularly restricted, and either can be positioned nearer the support.

However, in order to more effectively achieve the objects of the present invention, it is preferred for all of the photographic emulsion layers of the photographic light-sensitive material to comprise the negative type silver halide emulsion which fulfills the requirements of the average particle size, the amount of binder and the latent image distribution according to the present invention.

Although the silver halide emulsions used in the present invention need not necessarily be chemically sensitized, chemically sensitized silver halide emulsions are preferred. Processes for chemical sensitization of the silver halide emulsions which can be used include known sulfur sensitization, reduction sensitization and noble metal sensitization processes. In the noble metal sensitization processes, a gold sensitization process is a typical process where gold compounds or mainly gold complexes are used. Also, complex salts such as platinum, palladium, iridium, etc. complex salts may be used. A reduction sensitization process may be used if the process does not generate a fog which causes practical difficulties. A preferred chemical sensitization process for the present invention is the use of a sulfur sensitization process.

Examples of sulfur sensitizing agents which can be used include not only sulfur compounds present in the gelatin per se but also various sulfur compounds such as thiosulfates, thioureas, thiazoles or rhodanines, etc. Examples of suitable sulfur compounds are described in U.S. Pat. Nos. 1,574,944, 2,278,947, 2,410,689, 2,728,668, 3,501,313 and 3,656,955.

Preferred compounds represented by the general formula (I) are those compounds represented by the following general formula (Ia):

$$R^1NHNHCHO \qquad \text{(Ia)}$$

wherein $R^1$ has the same meaning as described in the general formula (I).

Particularly preferred compounds represented by the general formula (Ia) are those compounds represented by the general formula (Ib):

$$R^{11}NHNHCHO \qquad \text{(Ib)}$$

wherein $R^{11}$ represents an unsubstituted phenyl group or a tolyl group.

Examples of specific compounds represented by the general formula (I) which can be used in this invention are shown below. The present invention, however, is not to be construed as being limited to these specific compounds.

(I-1)

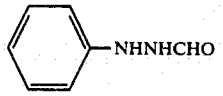

(I-2)

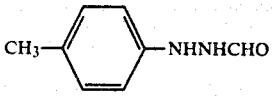

(I-3)

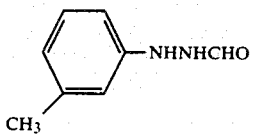

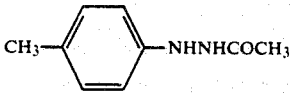

(I-4)

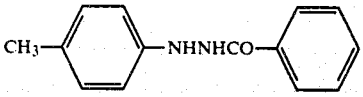

(I-5)

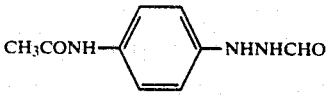

(I-6)

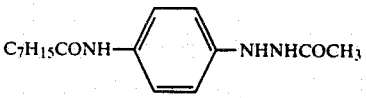

(I-7)

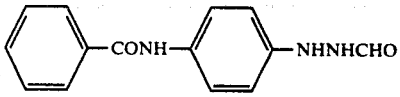

(I-8)

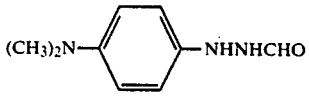

(I-9)

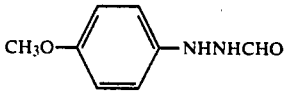

(I-10)

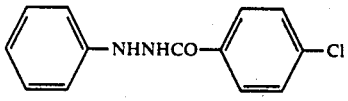

(I-11)

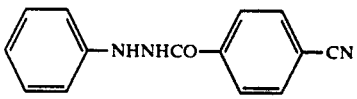

(I-12)

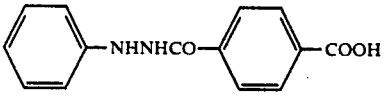

(I-13)

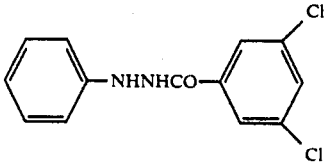

(I-14)

-continued

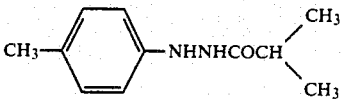

(I-15)

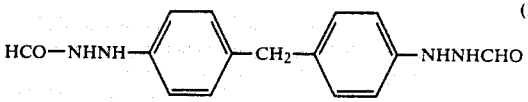

(I-16)

The compounds represented by the general formula (I) can be generally synthesized by reacting hydrazines with formic acid, by reacting hydrazines with orthoformic acid esters or by reacting hydrazine with acyl halides.

Starting material hydrazines such as

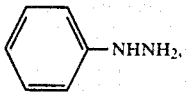

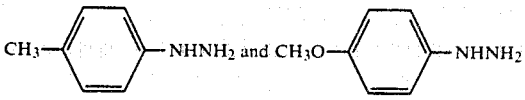

are commercially available and hydrazines of the formula

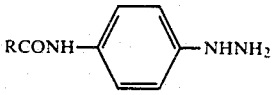

where R represents an alkyl group can be synthesized by reduction of a p-nitrophenylhydrazine. Suitable acyl halides which can be used include aliphatic acyl halides such as acetyl chloride, propionyl chloride, butyryl chloride, etc., and aromatic acyl halides such as benzoyl chloride, toluoyl chloride, etc. The reaction can be conducted in a solvent such as benzene, chloroform, pyridine, triethylamine, etc., and at a temperature of about 0° C. to about 100° C., preferably 0° C. to 70° C. A suitable molar ratio of the hydrazine to the acyl halide in the presence of a base such as pyridine or triethylamine which acts as a hydrogen halide acceptor for the hydrogen halide formed as a by-product ranges from about 1:1 to about 1:3, preferably 1:1.2 to 1:1.5 and in the absence of such a base ranges from about 1:0.3 to about 1:1, preferably 1:0.45 to 1:0.5. Hydrogen halide accepting agents such as triethylamine and pyridine can be employed in an amount of about one mol or more per mol of the acyl halide used.

Examples of synthesis of the compounds represented by the general formula (I) are described below. Unless otherwise indicated herein, all parts, percents, ratios and the like are by weight.

SYNTHESIS EXAMPLE 1 [SYNTHESIS OF COMPOUND (I-2)]

107 g of p-tolylhydrazine was added incrementally to 110 g of formic acid with stirring at 25° to 30° C. After the addition, the mixture was heated for 20 minutes with stirring at 50° C. After cooling with ice, the resulting crystals were separated by filtration and recrystallized from 550 ml of acetonitrile. Thus, 54.5 g of colorless needle-like crystals having a melting point of 176° C.–177° C. was obtained.

SYNTHESIS EXAMPLE 2 [SYNTHESIS OF COMPOUND (I-5)]

15 g of p-tolylhydrazine was added to 100 ml of acetonitrile at 25°–30° C. with stirring. 15 g of benzoyl chloride was then added dropwise at 25°–30° C. After the addition, stirring of the system was continued at 25°–30° C. for 6 hours. After cooling with ice, the resulting crystals were separated by filtration and recrystallized from benzene. Thus, 7 g of colorless needle-like crystals having a melting point of 146° C. was obtained.

When the compound represented by the general formula (I) is incorporated in a photographic light-sensitive material, the compound can be incorporated in the surface latent image type photographic emulsion layer according to the present invention or can be incorporated in another emulsion layer or a non-light-sensitive hydrophilic colloid layer (for example, a protective layer, an intermediate layer, an antihalation layer, etc.). Further, after producing the photographic light-sensitive material. The photographic material can be treated with a solution containing the compound described above. But it is preferred to add the compound represented by the general formula (I) to the surface latent image type photographic emulsion according to the present invention. To add the compound to a coating solution for a non-light-sensitive layer is secondarily preferred.

Where the compound represented by the general formula (I) is added to the surface latent image type silver halide emulsion according to the present invention, the compound can be added to the emulsion at any step of the preparation of the emulsion. It is preferred to add the compound after substantial completion of the chemical ripening.

The compound represented by the general formula (I) is incorporated in a photographic light-sensitive material generally in an amount of about $10^{-4}$ to about $10^{-1}$ mol/mol Ag of the silver halide grains according to the present invention per unit area. A preferred amount of the compound of the general formula (I) is $10^{-3}$ to $5\times10^{-2}$ mol/mol Ag and particularly $5\times10^{-3}$ to $5\times10^{-2}$ mol/mol Ag.

The addition of the compound represented by the general formula (I) can be carried out using conventional methods of adding additives to photographic emulsions. For example, the compound can be added to the emulsion as an aqueous solution having a suitable concentration where the compound is water soluble or as a solution in an organic solvent compatible with water such as alcohols, ethers, glycols, ketones, esters or amides which do not adversely influence the photographic properties where the compound is insoluble or poorly soluble in water. Known methods similar to the addition of water insoluble couplers (the so-called oil soluble couplers) to emulsions as a dispersion can also be used. Similar methods can be used where the compound is to be added to a coating solution for a non-light sensitive layer.

Examples of specific compounds represented by the general formula (II) or (III) are shown below. The present invention, however, is not to be construed as limited to these specific compounds.

(II-1)

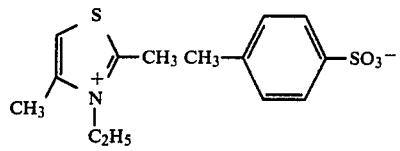

(II-2)

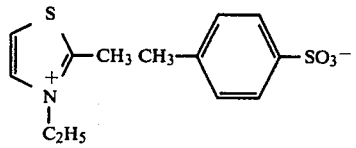

(II-3)

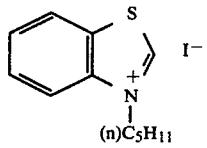

(II-4)

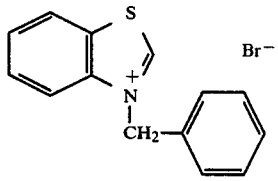

(II-5)

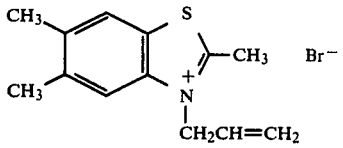

(II-6)

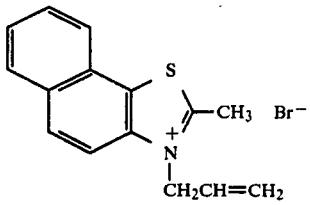

(II-7)

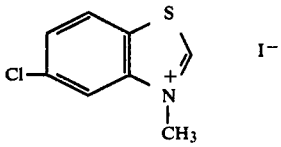

(II-8)

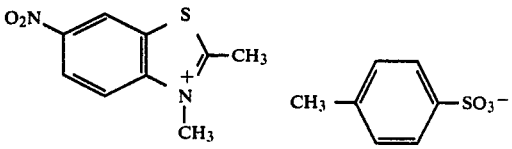

(II-9)

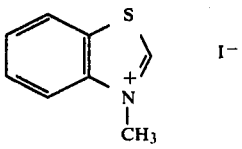

(II-10)

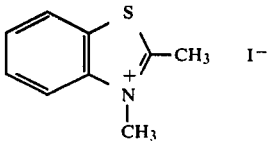

-continued (II-11)

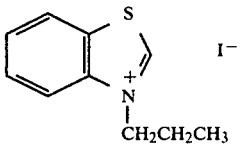

(II-12)

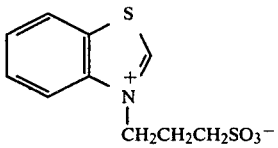

(II-13)

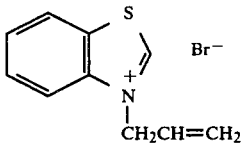

(II-14)

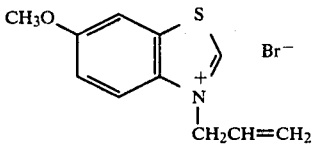

(II-15)

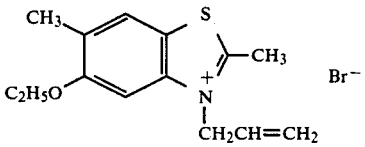

(II-16)

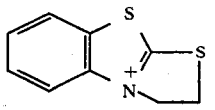

(II-17)

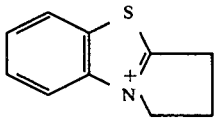

(II-18)

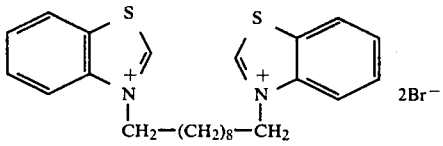

(II-19)

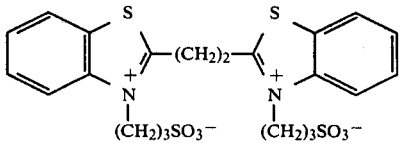

(II-20)

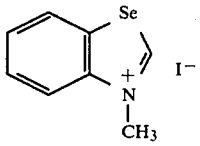

The compounds represented by the general formula (II) or (III) can be synthesized using the methods described in U.S. Pat. Nos. 2,131,038; 2,334,864; 2,425,774; 2,500,110; 2,694,716, etc.

Specific examples of the synthesis of the compounds represented by the general formula (II) or (III) are described below.

SYNTHESIS EXAMPLE 3

Synthesis of Compound (II-1)

11.3 g of 2,4-dimethylthiazole and 20 g of ethyl p-toluene sulfonate were mixed and heated at about 100° C. on a water bath for 4 hours. After cooling, acetone was added to the mixture to cause crystallization. The crystals were recrystallized from acetone. Yield 12 g; Melting Point 54°-55° C.

| Elemental Analysis | C | H | N |
|---|---|---|---|
| Calculated (%) | 53.67 | 6.07 | 4.47 |
| Found (%) | 53.41 | 6.29 | 4.16 |

SYNTHESIS EXAMPLE 4

Synthesis of Compound (II-6)

12.1 g of allyl bromide and 19.9 g of 2-methyl-α-naphthothiazole were mixed and heated using a bath at a temperature of 130° C. for 4 hours. The crystals formed were recrystallized from methanol. Yield 18 g; Melting Point 211° to 212° C.

| Elemental Analysis | C | H | N |
|---|---|---|---|
| Calculated (%) | 56.25 | 4.38 | 4.38 |
| Found (%) | 56.29 | 4.35 | 4.67 |

SYNTHESIS EXAMPLE 5

Synthesis of Compound (II-9)

20.7 g of 2,6-dimethyl-5-ethoxybenzothiazole and 13.5 g of allyl bromide were mixed, 50 ml of benzene was added thereto and the mixture was heated using a bath at a temperature of 130° C. for 15 hours. The crystals formed were recrystallized from acetonitrile. Yield 5 g; Melting Point 203° to 205° C.

| Elemental Analysis | C | H | N |
|---|---|---|---|
| Calculated (%) | 51.22 | 5.49 | 4.27 |
| Found (%) | 51.06 | 5.51 | 4.28 |

SYNTHESIS EXAMPLE 6

Synthesis of Compound (II-10)

16 g of 2-methylthiobenzothiazole and 20 g of 1,2-dibromoethane was mixed and heated using a bath at a temperature of 160° C. for 3 hours. The crystals formed were recrystallized from ethanol. Yield 15 g; Melting Point 257° to 258° C.

| Elemental Analysis | C | H | N |
|---|---|---|---|
| Calculated (%) | 39.41 | 2.92 | 5.11 |
| Found (%) | 39.53 | 3.21 | 5.09 |

Other compounds represented by the general formula (II) or (III) can be easily prepared in a similar manner to that described above by those skilled in the art.

In order to develop a silver halide photographic light-sensitive material in the presence of the compound represented by the general formula (II) or (III) according to the method of the present invention, the compound represented by the general formula (II) or (III)

can be incorporated in a photographic light-sensitive material or can be added to a developer solution. Further, a light-sensitive material can be treated with a bath containing the compound represented by the general formula (II) or (III) after exposure to light but before development. Where the compound is incorporated in a photographic light-sensitive material, the compound can be incorporated in a photographic emulsion layer or can be incorporated in a non-light-sensitive layer, for example, a protective layer, an intermediate layer, a filter layer, an antihalation layer, etc. The compound represented by general formula (II) or (III), however, is preferably incorporated in a surface latent image type silver halide photographic emulsion layer containing the silver halide grains and the binder fulfilling the requirements according to the present invention together with the compound represented by the general formula (I).

The compound represented by the general formula (II) or (III) is incorporated in a photographic light-sensitive material in an amount of about $10^{-5}$ to about $10^{-1}$ mol/mol Ag, particularly $10^{-4}$ to $10^{-2}$ mol/mol Ag of the silver halide present in a unit area. The optimum amount of the compound to be added is preferably selected depending on the grain size of the silver halide, the silver halide composition, the method and degree of chemical sensitization, the relationship of the layer containing the compound and other photographic emulsion layers, the kind of anti-fogging compound, and the like. The selection can be easily carried out by the skilled artisan, since methods for determination of the optimum amount are well known.

In order to incorporate the compound represented by the general formula (II) or (III) in a silver halide emulsion layer or other non-light-sensitive hydrophilic colloid layers, the compound represented by the general formula (II) or (III) can be added to a photographic emulsion or a coating solution for a non-light-sensitive layer. For this purpose, methods the same as described above for incorporation of the compound represented by the general formula (I) into an photographic emulsion can be used. Specifically, the compound can be added to a solution of a hydrophilic colloid as a solution in an organic solvent compatible with water, such as an alcohol (for example, methanol, ethanol, etc.), an ester (for example, ethyl acetate, etc.), a ketone (for example, acetone, etc.), and the like, or as an aqueous solution when the compound is water soluble. An alkaline aqueous solution or an acidic aqueous solution may be used when such a solution is advantageous for dissolving the compound.

When the compound is added to a photographic emulsion, although the addition can be carried out at any step from the beginning of chemical ripening to before coating, incorporation after chemical ripening is preferred. In particular, addition of the compound represented by the general formula (II) or (III) to a coating solution ready for coating is preferred.

Where the compound represented by the general formula (II) or (III) is added to a developer solution or a processing bath prior to development, the same methods for dissolving the compound as described for adding the compound to an emulsion are also used.

Where the compound represented by the general formula (II) or (III) is added to a developer solution, a preferred amount is about $10^{-5}$ to about $10^{-2}$ mol/liter of the developer solution. Particularly an amount of $1\times10^{-4}$ to $5\times10^{-3}$ mol/liter of the developer solution is preferred.

The photographic emulsions used in the present invention can be prepared by processes described in P. Glafkides, *Chimie et Physique Photographique,* Paul Mondel Co. (1967), G. F. Duffin, *Photographic Emulsion Chemistry,* The Focal Press (1966) and V. L. Zelikman et al., *Making and Coating Photographic Emulsions,* The Focal Press (1964). Namely, they may be prepared by any of an acid process, a neutral process or an ammonia process. Further, a single-jet process, a double-jet process or a combination thereof may be used as a process of reacting soluble silver salts with soluble halide salts.

A process of forming grains under conditions where an excess of silver ion (the so-called reverse mixing process) is present can also be used. One type of double-jet mixing process which can be used is a process which comprises holding the pAg constant in the liquid phase where silver halide is formed, namely, the so-called controlled double-jet process. According to this process, silver halide emulsions having a regular crystal form and a uniform grain size can be obtained.

The silver halide grains in the photographic emulsions of the invention may have a regular form such as a cubic form or an octahedral form. Further, they may have an irregular crystal form such as that of a sphere or a plate, etc., or they may have a complex form of these crystal forms. Also photographic emulsions containing a mixture of grains of various crystal forms can be used.

The silver halide grains may have a structure in which the inner part and the outer part are each composed of a different phase or may have a structure which is uniform throughout.

In forming the silver halide grains or during physical ripening, cadmium salts, zinc salts, lead salts, thalium salts, rhodium salts or complexes thereof, or iron salts or complexes thereof, etc., may also be present. Further, iridium salts or complexes thereof may also be present as long as substantially surface latent image type grains are formed.

Two or more silver halide emulsions produced separately may be used by mixing them, if desired.

The soluble salts are generally removed from the emulsion after formation of the precipitates or after physical ripening. The well known noodle water washing process which is carried out after gelling of the hydrophilic colloid may be used for this purpose. Further, flocculation processes utilizing inorganic salts containing a polyvalent anion, such as sodium sulfate, anionic surface active agents, anionic polymers (such as polystyrene sulfonic acid) or gelatin derivatives (such as aliphatic acylated gelatins, aromatic acylated gelatins, or aromatic carbamoylated gelatins, etc.) can be used. The removal of the soluble salts may be omitted, if desired.

Although emulsions which are not chemically sensitized (the so-called primitive emulsion) may be used as the silver halide emulsions, the silver halide emulsions are usually chemically sensitized. For the purpose of chemical sensitization, a sulfur sensitization process using a labile sulfur containing-compound capable of reacting with silver ion or active gelatin is preferred. A noble metal sensitization process using a noble metal compound (for example, gold compounds) may be used in combination therewith. Complex salts of Group VIII metals of the Periodic Table, such as platinum, iridium or palladium, etc., can be used for noble metal sensitization and examples thereof are described in U.S. Pat. No. 2,448,060 and British Pat. No. 618,061, etc.

The photographic light-sensitive material which can be used in the present invention can contain in the silver halide emulsion layers or other hydrophilic colloid layers thereof an anti-fogging agent other than the compounds represented by the general formula (II) or (III). For example, an 1,2,3-triazole compound (particularly, a benzotriazole), a heterocyclic compound having a mercapto group, a benzimidazole, etc. can be employed.

If a small amount of iodide (for example, potassium iodide) is added to the emulsions after formation of the silver halide grains, before chemical ripening, after chemical ripening or before coating, the effect of the present invention is even further increased. A preferred amount of iodide to be added is about $10^{-4}$ to about $10^{-2}$ mol/mol Ag.

The photographic emulsions of the present invention may be spectrally sensitized with methine dyes or the like. Examples of suitable dyes which can be used include cyanine dyes, merocyanine dyes, complex cyanine dyes, complex merocyanine dyes, holopolar cyanine dyes, hemicyanine dyes, styryl dyes and hemioxonol dyes. Particularly preferred dyes are cyanine dyes, merocyanine dyes and complex merocyanine dyes. These dyes may contain nuclei commonly used as basic heterocyclic nuclei in cyanine dyes. Namely, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above-described nuclei; and nuclei wherein an aromatic hydrocarbon ring is fused to the above-described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, etc., can be employed. The carbon atoms of these nuclei may be substituted with substituents.

The merocyanine dyes or complex merocyanine dyes may contain 5- or 6-membered heterocyclic rings such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc.

Useful sensitizing dyes are those described in German Pat. No. 929,080, U.S. Pat. Nos. 2,231,658, 2,493,748, 2,503,776, 2,519,001, 2,912,329, 3,656,959, 3,672,897 and No. 3,694,217, British Pat. No. 1,242,588 and Japanese Pat. No. 14030/1969.

These sensitizing dyes may be used individually or as a combination thereof. Combinations of sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and No. 3,837,862, British Pat. No. 1,344,281 and Japanese Pat. No. 4936/1968.

The emulsions may contain dyes which do not have a spectral sensitization function themselves or materials which do not substantially absorb visible light but give rise to a supersensitization together with the sensitizing dyes. For example, aminostilbene compounds substituted with a nitrogen containing heterocyclic group (such as those described in, for example, U.S. Pat. No. 2,933,390 and No. 3,635,721), aromatic organic acid-formaldehyde condensation products (for example, those described in U.S. Pat. No. 3,743,510), and azaindene compounds may be employed. The combinations described in U.S. Pat. Nos. 3,615,613, 3,615,641, 3,617,295 and No. 3,635,721 are particularly useful.

The photographic light-sensitive materials used in the present invention may contain water soluble dyes as filter dyes or for the purpose of preventing light-scattering, for the purpose of antihalation or for other purposes. Examples of such dyes include oxonol dyes, hemioxonol dyes, styryl dyes, merocyanine dyes, cyanine dyes and azo dyes. Above all, oxonol dyes, hemioxonol dyes and merocyanine dyes are particularly preferred. Examples of these dyes which can be used include thoese described in British Pat. No. 584,609 and No. 1,177,429, Japanese patent application (OPI) Nos. 85130/1973, 99620/1974 and No. 114420/1974, and U.S. Pat. Nos. 2,274,782, 2,533,472, 2,956,879, 3,148,187, 3,177,078, 3,247,127, 3,540,887, 3,575,704, 3,653,905 and No. 3,718,472.

The photographic light-sensitive materials according to the present invention may contain inorganic or organic hardening agents in appropriate hydrophilic colloid layers thereof. For example, chromium salts (chrome alum or chromium acetate, etc.), aldehydes (formaldehyde, glyoxal or glutaraldehyde, etc.), N-methylol compounds (dimethylolurea or methyloldimethylhydantoin, etc.), dioxane derivatives (2,3-dihydroxydioxane, etc.), active vinyl compounds (1,3,5-triacryloylhexahydro-s-triazine or bis-(vinylsulfonyl) methyl ether, etc.), active halogen compounds (2,4-dichloro-6-hydroxy-s-triazine, etc.), mucohalic acids (mucochloric acid or mucophenoxychloric acid, etc.), isoxazoles, dialdehyde starch and 2-chloro-6-hydroxytriazinyl gelatin, etc., which may be used individually or as a combination of two or more thereof. Examples of suitable hardening agents include those described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and No. 3,543,292, British Pat. Nos. 676,628, 825,544 and No. 1,270,578, German Pat. No. 872,153 and No. 1,090,427 and Japanese Pat. No. 7133/1959 and No. 1872/1971.

The photographic light-sensitive material can contain couplers to produce color photographic light-sensitive materials. All ketomethylene yellow dye-forming couplers can advantageously be used. Typical examples thereof are couplers of the benzoylacetanilide series, pivalylacetanilide series, etc. Further, all magenta dye-forming couplers of the pyrazolone series, indazolone series, etc., can advantageously be used. In addition, all cyan dye-forming couplers of the phenol series, naphthol series, etc., can advantageously be used. These couplers may contain a coupling-off group at the active carbon atom positioned at the coupling site. Those couplers rendered nondiffusible with a ballast group are preferred. A large number of ballasted compounds are well known for these couplers.

These dye-forming couplers can be dispersed in a hydrophilic colloid in any known manner. They can advantageously be dispersed with the use of a coupler solvent as described in U.S. Pat. No. 2,322,027, etc.

The photographic light-sensitive materials used in the present invention may contain various known surface active agents for various purposes, e.g., as a coating aid, for preventing the generation of electrostatic charges, for improving lubricating properties, for emulsifying or dispersing, for preventing adhesion and for improving the photographic properties (for example, acceleration of development, increasing contrast or sensitization), etc.

Examples of suitable surface active agents include nonionic surface active agents such as saponin (steroid type), alkylene oxide derivatives (for example, polyethylene glycol, polyethylene glycol-polyproplylene glycol condensation products, polyethylene glycol alkyl or alkylaryl ethers, polyethylene glycol esters, polyethylene glycol sorbitan esters, polyalkylene glycol alkylamines or amides or polyethylene oxide addition products of silicones, etc.), glycidol derivatives (for example, alkenylsuccinic acid polyglycerides or alkylphenol polyglycerides), aliphatic acid esters of polyhydric alcohols, alkyl esters of saccharides, urethanes of saccharaides or ethers of saccharides, etc.; anionic surface active agents containing acid groups such as a carboxyl group, a sulfo group, a phospho group, a sulfate group or a phosphate group, etc., such as triterpenoid type saponin, alkylcarboxylic acid salts, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkylpolyoxyethylene alkylphenyl ethers or polyoxyethylene alkyl phosphoric acid esters, etc.; amphoteric surface active agents such as amino acids, aminoalkylsulfonic acids, aminoalkyl sulfates or phosphates, alkylbetaines, amine imides or amine oxides, etc.; and cationic surface active agents such as alkylamine salts, aliphatic or aromatic quaternary ammonium salts, heterocyclic quaternary ammonium salts such as pyridinium or imidazolidium salts, etc., or aliphatic or heterocyclic phosphonium or sulfonium salts, etc.

Examples of these surface active agents include those described in U.S. Pat. Nos. 2,240,472, 2,831,766, 3,158,484, 3,210,191, 3,294,540 and No. 3,507,660, British Pat. Nos. 1,012,495, 1,022,878, 1,179,290 and No. 1,198,450, Japanese patent application (OPI) No. 117414/1975, U.S. Pat. Nos. 2,739,891, 2,823,123, 3,068,101, 3,415,649, 3,666,478 and No. 3,756,828, British Pat. No. 1,397,218, U.S. Pat. Nos. 3,133,816, 3,441,413, 3,475,174, 3,545,974, 3,726,683 and No. 3,843,368, Belgian Pat. No. 731,126, British Pat. Nos. 1,138,514, 1,159,825 and No. 1,374,780, Japanese Pat. Nos. 378/1965, 379/1965 and No. 13822/1968, U.S. Pat. No. 2,271,623, 2,288,226, 2,944,900, 3,253,919, 3,671,247, 3,772,021, 3,589,906, 3,666,478 and No. 3,754,924, German patent application (OLS) No. 1,961,638 and Japanese patent application (OPI) No. 59025/1975.

The photographic light-sensitive material used in the present invention may contain an aqueous dispersion of water insoluble or poorly soluble synthetic polymers for the purpose of improving dimensional stability. Examples of polymers which can be used include polymers composed of one or more of an alkyl acrylate or methacrylate, alkoxyalkyl acrylate or methacrylate, glycidyl acrylate or methacrylate, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylate or methacrylate, sulfoalkyl acrylate or methacrylate or styrenesulfonic acid, etc. For example, the polymers described in U.S. Patents Nos. 2,376,005, 2,739,137, 2,853,457, 2,062,674, 3,411,911, 3,488,708, 3,525,620, 3,607,290, 3,635,715 and 3,645,740, and British Patents 1,186,699 and 1,307,373 can be used. The contrasty emulsions as in the present invention are suitable for reproduction of line images. Accordingly, since dimensional stability is important in such a use, the light-sensitive material preferably contains such a polymer dispersion in the present invention.

Exposure to light for obtaining a photographic image can be performed in a usual manner. Various known light sources such as natural light (sunlight), a tungsten lamp, a fluorescent light, a mercury lamp, a xenon arc lamp, a carbon arc lamp, a xenon flash lamp or a cathode ray tube flying spot can be used. The exposure time can, of course, by 1/1,000 sec. to 1 sec. which is usually employed with cameras, and further, exposure for shorter than 1/1,000 sec., for example, $1/10^4$ to $1/10^6$ sec. which is employed in case of using a xenon flash lamp or a cathode ray tube, and exposure for longer than 1 sec. can be employed. If desired, the spectral composition of the light used for the exposure can be controlled using a color filter. The fluorescence resulting from the excitation of a phosphor caused by ionizing radiation or a laser beam can also be used for exposure. Moreover, exposure to electron radiation, X-rays, $\gamma$-rays or $\alpha$-rays may be employed.

Any known process can be used for the photographic processing of the photographic light-sensitive material in the present invention. Known processing solutions can be used. The processing temperatuure is usually selected within the range of about 18° C. to about 50° C. But the temperature used may be lower than about 18° C. or higher than about 50° C. The present invention is suitable for development processing for forming silver images (black-white photographic processing) but the present invention may be used for color photographic processing comprising development for forming dye images.

The developers used for black-and-white photographic processing preferably contain, as a developing agent, amino-phenols (such as N-methyl-p-aminophenol), 3-pyrazolidones (such as 1-phenyl-3-pyrazolidone), 1-phenyl-3-pyrazolines, etc. The developers may further contain dihydroxybenzenes (such as hydroquinone), ascorbic acid, etc. Moreover, the developers usually contain a known antioxidant, an alkali agent, a pH buffer or the like and, if desired, a dissolving aid, a color toning agent, a development accelerator, a surface active agent, an anti-foaming agent, a water softener, a hardener, a tackifier, etc., may be present. An anti-fogging agent (such as an alkali metal halide or benzotriazole) may be present in the developer.

Color developers commonly used in the art can also be used in the present invention, i.e., any alkaline aqueous solution containing a color-developing agent. All known dyeforming aromatic primary amine developers such as phenylenediamines (e.g., N,N-diethyl-p-phenylenediamine, N-ethyl-N-hydroxyethyl-p-phenylenediamine, N-ethyl-N-hydroxyethyl-2-methyl-p-phenylenediamine, N-ethyl-$\beta$-methanesulfonamidoethyl-3-methyl-4-aminoaniline, N,N-diethyl-2-methyl-p-phenylenediamine, and the sulfonates, hydrochlorides and sulfites thereof, etc.) can be used as the color-developing agents. The color developer may further contain generally used additives such as a sulfite, carbonate, bisulfite, alkali metal, bromides or iodides, benzyl alcohol and the like.

According to this invention, even when development is carried out using a developer containing more than about 0.15 mol/l of sulfite ions, a $\gamma$ of more than 8 can be obtained. The pH of the developer is preferably about 11 to about 12.3. If the pH is below about 11, it is difficult to obtain a very contrasty image. If the pH exceeds about 12.3, the developer is unstable even when a high concentration of sulfite ions is present, and it is difficult to maintain stable photographic characteristics for more than 3 days under usual use conditions.

Those fixing solutions having a composition generally employed in the art can be used in the present invention. Not only thiosulfates and thiocyanates but also organic sulfur compounds known as fixing agents can be used as fixing agents in the present invention.

Suitable preferred examples of fixing agents which can be used in the fixing solution include water-soluble thiosulfates such as sodium thiosulfate, potassium thiosulfate, ammonium thiosulfate, etc., water-soluble thiocyanates such as sodium thiocyanate, potassium thiocyanate, ammonium thiocyanate, etc., water-soluble organic diol fixing agents containing an oxygen atom or a sulfur atom such as 3-thia-1,5-pentanediol, 3,6-dithia-1,8-octanediol, 9-oxa-3,6,12,15-tetrathia-1,17-heptadecanediol, etc., water-soluble sulfur containing organic dibasic acids and water-soluble salts thereof such as ethylenebisthioglycollic acid and the sodium salt thereof, etc., imidazolidinethiones such as methylimidazolidinethione, etc. Further, the fixing agents described in L. F. A. Mason, *Photographic Processing Chemistry,* pages 187 to 188, Focal Press (1966) are also preferred.

Other processing solutions, e.g., a bleaching solution, a fixing solution, a stabilizing solution, etc., known in the art also may advantageously be used. These processing solutions may be used in combination, e.g., as a bleach-fixing solution, a fix-stabilizing solution or a bleach-fix-stabilizing solution.

Such solutions are well known in the art, and any of such known solutions are useful. A bleaching solution contains a silver oxidizing agent(s), e.g., water-soluble ferricyanides, a simple water-soluble ferric, cupric or cobaltic salt, and complex salts of an alkali metal and polyvalent cations with an organic acid. Typical examples of polyvalent cations are ferric ions, cobaltic ions, cupric ions, etc. Typical examples of the organic acids are ethylenediaminetetraacetic acid, nitrilotriacetic acid, etc.

The following examples are given to illustrate the present invention in greater detail.

EXAMPLE 1

To an aqueous solution of gelatin held at 50° C., an aqueous solution of silver nitrate and an aqueous solution of potassium bromide were added at the same time over a 50 minute period while the pAg was kept at 7.9, by which a silver bromide emulsion having an average grain size of 0.25$\mu$ was produced. After the water soluble salts were removed from the resulting emulsion, sodium thiosulfate was added in an amount of 43 mg per mol of silver bromide and the emulsion was chemically ripened at 60° C. for 60 minutes. The resulting emulsion contained 120 g of gelatin per mol of silver bromide. The internal sensitivity of this emulsion was much lower than the surface sensitivity, and the internal sensitivity could be disregarded.

To the resulting silver halide emulsion, Compound (I-2) of the present invention and the compound represented by the general formula (II) in the amounts as shown in Table 1 below were added to prepare various emulsions. After a hardening agent (sodium salt of 2-hydroxy-4,6-dichloro-1,3,5-triazine) was added to each emulsion, they were coated each on a cellulose triacetate film in an amount of 45 mg of silver per 100 cm$^2$ to produce photographic materials. After each sample was exposed to light for 1 second through a light wedge, each sample was developed at 20° C. for 3 minutes using a developer solution having the following composition

| | |
|---|---|
| N-Methyl-p-aminophenol Hemisulfate | 5 g |
| Hydroquinone | 10 g |
| Sodium Sulfite (anhydrous) | 75 g |
| Sodium Metaborate (tetrahydrate) | 30 g |
| Potassium Hydroxide | 12 g |
| Water to make | 1 l |
| | (pH 11.5) |

and then each sample was subjected to conventional processings as below.

| Processing Step | | |
|---|---|---|
| Stopping | 20° C. | 30 sec. |
| Fixing | " | 5 min. |
| Water Washing | " | 30 min. |
| Drying | 40° C. | 15 min. |

The processing solutions had the following compositions

| Stopping Bath | |
|---|---|
| Acetic Acid (28% aq. soln.) | 48 cc |
| Water to make | 1 l |

| Fixing Bath | |
|---|---|
| Sodium Thiosulfate | 240 g |
| Sodium Sulfite (anhydrous) | 15 g |
| Acetic Acid (28% aq. soln.) | 48 cc |
| Boric Acid | 7.5 g |
| Potassium Alum | 15 g |
| Water to make | 1 l |

The resulting photographic characteristics obtained are shown in Table 1. In Table 1, the relative sensitivity is represented as a relative value of the reciprocal of the amount of exposure required to achieve an optical density of 2.0 above the fog density, with the sensitivity of Sample 1 being assumed to be 100.

TABLE 1

| Run No. | Amount of Compound (I-2) (mol/mol Ag) | Compound (II) Compound | Compound (II) Amount (mol/mol Ag) | Photographic Properties Fog | Photographic Properties Relative Sensitivity | Photographic Properties $\gamma$ |
|---|---|---|---|---|---|---|
| 1 | — | — | — | 0.62 | 100 | 6.1 |
| 2 | $2.2 \times 10^{-2}$ | — | — | 0.81 | 180 | 15 |
| 3 | " | (II-9) | $6.8 \times 10^{-4}$ | 0.12 | 175 | >20* |
| 4 | " | " | $2.0 \times 10^{-3}$ | 0.07 | 210 | " |
| 5 | " | " | $6.1 \times 10^{-3}$ | 0.04 | 186 | " |
| 6 | " | (II-13) | $6.8 \times 10^{-4}$ | 0.09 | 166 | 14 |
| 7 | " | " | $2.0 \times 10^{-3}$ | 0.04 | 195 | >20 |
| 8 | " | (II-10) | $2.0 \times 10^{-3}$ | 0.17 | 170 | " |
| 9 | " | " | $6.1 \times 10^{-3}$ | 0.09 | 190 | " |
| 10 | " | (II-14) | $2.0 \times 10^{-3}$ | 0.10 | 180 | 18 |
| 11 | " | " | $6.1 \times 10^{-3}$ | 0.08 | 160 | 18 |
| 12 | " | (II-11) | $4.5 \times 10^{-4}$ | 0.17 | 180 | >20 |
| 13 | " | " | $1.4 \times 10^{-3}$ | 0.06 | 195 | " |

TABLE 1-continued

| Run No. | Amount of Compound (I-2) (mol/mol Ag) | Compound (II) Compound | Compound (II) Amount (mol/mol Ag) | Photographic Properties Fog | Photographic Properties Relative Sensitivity | Photographic Properties γ |
|---|---|---|---|---|---|---|
| 14 | " | " | $4.1 \times 10^{-3}$ | 0.04 | 180 | " |
| 15 | " | (II-16) | $6.4 \times 10^{-4}$ | 0.13 | 310 | 18 |
| 16 | " | (II-18) | $6.4 \times 10^{-4}$ | 0.08 | 186 | 18 |

*A γ value of above 20 cannot be measured using a densitometer.

As can be understood from the results in Table 1 above, an image having a γ of above 10 and a high sensitivity with a lesser extent of fog formation can be obtained using a stable developer solution having a pH of 11.5 according to the present invention.

EXAMPLE 2

The following three silver halide emulsions A, B and C each having an average grain size of 0.25μ and containing 120 g of gelatin per mol of silver were prepared.

Emulsion A: Silver bromide emulsion same as described in Example 1.

Emulsion B: Silver iodobromide emulsion containing 2 mol % of silver iodide which was prepared in the same manner as described in Example 1 except that potassium iodide in an amount corresponding to 2 mol % was added to the aqueous solution of potassium bromide.

Emulsion C: Silver chlorobromide emulsion prepared in the same manner as described in Example I except a mixture of an aqueous solution of potassium bromide and sodium chloride was added together with the aqueous solution of silver nitrate to the aqueous gelatin solution. The amount of sodium chloride used corresponded to 20 mol % of the amount of silver nitrate.

Water soluble salts were removed from Emulsions A, B and C and they were chemically ripened. To each resulting emulsion, $2.2\times10^{-2}$ or $3.2\times10^{-2}$ mol/mol Ag of Compound (I-2) and Compound (II-13) in the amount as shown in Table 2 below were added.

After hardening agent was added, each emulsion was coated, exposed and processing in the same manner as described in Example 1 to obtain the photographic characteristics. The results obtained are shown in Table 2 below.

TABLE 2

| Run No. | Emulsion | Compound (I-2) (mol/mol Ag) | Compound (II-13) (mol/mol Ag) | Photographic Properties Fog | Photographic Properties Relative Sensitivity | Photographic Properties γ |
|---|---|---|---|---|---|---|
| 1 | A | — | — | 0.62 | 100 | 6 |
| 2 | " | $2.2 \times 10^{-2}$ | — | 0.81 | 180 | 15 |
| 3 | " | " | $6.8 \times 10^{-4}$ | 0.09 | 166 | 14 |
| 4 | " | " | $2.0 \times 10^{-3}$ | 0.04 | 195 | 20 |
| 5 | B | — | — | 0.76 | 100 | 5 |
| 6 | " | $2.2 \times 10^{-2}$ | — | 0.78 | 160 | 15 |
| 7 | " | " | $7.1 \times 10^{-4}$ | 0.34 | 155 | >20 |
| 8 | " | " | $2.8 \times 10^{-3}$ | 0.06 | 145 | " |
| 9 | C | — | — | 0.34 | 100 | 3.5 |
| 10 | " | $3.2 \times 10^{-2}$ | — | 0.36 | 170 | 9 |
| 11 | " | " | $4.9 \times 10^{-3}$ | 0.08 | 140 | 10 |

The relative sensitivity is the same as defined in Example 1 except that in Run No. 1 (Emulsion A), No. 5 (Emulsion B) and No. 9 (Emulsion C), the relative sensitivity of 100 for each of these does not show the same sensitivity but instead serves as a standard for each such emulsion only.

It can be understood from the results in Table 2 above using light-sensitive materials and the present invention, i.e., Samples 3, 4, 7, 8, 11 and 12, provide images of an extremely high γ and a high sensitivity in comparison with samples which do not contain both Compound (I-2) and Compound (II-13). Further, when these samples are compared with the samples containing Compound (I-2) alone i.e., Samples 2, 6 and 10, it is apparent that the γ increases much more and the sensitivity also increases in certain cases, i.e., in the case of Emulsion A, by using Compound (II-13).

It is an unexpected and surprising effect that the compounds represented by the general formula (II) which are known as anti-fogging agents provide an increase of contrast and also occasionally an increase in sensitivity, since it is well known that anti-fogging agents generally decrease the fog but also decrease the sensitivity and contrast.

EXAMPLE 3

Light-sensitive film samples were prepared in the same manner as the sample for Run No. 3 in Example 1 except that Compound (I-1), (I-4) or (I-7) in the amounts as shown in Table 3 below was used in place of Compound (I-2) and Compound (II-9) in an amount of $2.83\times10^{-3}$ mol/mol Ag was used. Also samples in which Compound (II-9) was not used corresponding to the above-described samples were prepared.

After each sample was exposed to light for 1 second through a light wedge, the sample was developed at 20° C. for 3 minutes using a developing solution having the following composition

| | |
|---|---|
| N-Methyl-p-aminophenolhemisulfate | 5 g |
| Hydroquinone | 10 g |
| Sodium Sulfite (anhydrous) | 75 g |
| Sodium Metaborate (tetrahydrate) | 30 g |
| Potassium Hydroxide | 15 g |
| Water to make | 1 l |
| | (pH 12.0) |

and the sample was then subjecting to same conventional processings as described in Example 1.

The resulting photographic properties obtained are shown in Table 3 below.

TABLE 3

| Run No. | Compounds of General Formula (I) Compund | Amount (mol/mol Ag) | Compounds of General Formula (II) Compound | Amount (mol/mol Ag) | Photographic Characteristics Fog | Relative sensitivity | γ |
|---|---|---|---|---|---|---|---|
| 1 | — | — | — | — | 0.56 | 100 | 6 |
| 2 | (I-1) | $2.1 \times 10^{-2}$ | — | — | 0.56 | 330 | 16 |
| 3 | " | " | (II-9) | $2.83 \times 10^{-3}$ | 0.06 | 360 | >20 |
| 4 | (I-4) | $1.7 \times 10^{-2}$ | — | — | 0.56 | 280 | >20 |
| 5 | " | " | (II-9) | $2.83 \times 10^{-3}$ | 0.06 | 270 | 20 |
| 6 | (I-7) | $1 \times 10^{-2}$ | — | — | 0.58 | 250 | 12 |
| 7 | " | " | (II-9) | $2.83 \times 10^{-3}$ | 0.06 | 260 | 12 |

As can be understood from the results in Table 3 above, an image having a γ of above 10 and a high sensitivity in addition to a lower degree of fog formation can be obtained using a stable developer solution having a pH of 12 when Compound (I-1), (I-4) or (I-7) was used together with Compound (II-9).

EXAMPLE 4

Samples corresponding to those used in Run No. 1 not containing Compound (I-2) and to Run No. 2 containing $2.2 \times 10^{-2}$ mol/mol Ag of Compound (I-2) of Example 1 were exposed to light for 1 second through a light wedge and developed with a developer solution which had been prepared by adding Compound (II-9), (II-13) or (II-10), as methanol solutions, in the amounts shown in Table 4 below, to the developer solution as described in Example 1 at 20° C. for 3 minutes followed by conventional photographic processing, i.e., stopping, fixing, washing and drying, as described in Example 1.

The photographic properties obtained are shown in Table 4 below.

TABLE 4

| Run No. | Run No. of Example 1 | Compound (II) Compound | Amount (mol/l) | Photographic Characteristics Fog | Relative sensitivity | γ |
|---|---|---|---|---|---|---|
| 1 | 1 | — | — | 0.62 | 100 | 6 |
| 2 | 2 | — | — | 0.81 | 180 | 15 |
| 3 | 1 | (II-9) | $1.3 \times 10^{-3}$ | 0.15 | 60 | 6 |
| 4 | 2 | " | " | 0.15 | 140 | 12 |
| 5 | 1 | (II-10) | $1.3 \times 10^{-3}$ | 0.20 | 58 | 6 |
| 6 | 2 | " | " | 0.16 | 170 | 14 |
| 7 | 1 | (II-13) | $1.3 \times 10^{-3}$ | 0.18 | 95 | 6 |
| 8 | 2 | (II-13) | $2.3 \times 10^{-4}$ | 0.24 | 180 | 15 |
| 9 | 2 | " | $1.3 \times 10^{-3}$ | 0.18 | 172 | 15 |
| 10 | 2 | " | $2.7 \times 10^{-3}$ | 0.10 | 135 | 12 |

It can be understood from the results in Table 4, an image having a high gamma and a low fog can be obtained according to the process for forming an image of the present invention in which the compound represented by the general formula (II) is added to a developer solution.

While the invention has been described in detail and with reference to specific embodiments thereof, it will be apparent to one skilled in the art that various changes and modifications can be made therein without departing from the spirit and scope thereof.

What is claimed is:

1. A process for forming a negative photographic image which comprises developing with a developing solution containing at least one para dihydroxy benzene compound as a developing agent an imagewise exposed photographic light-sensitive material comprising a support having thereon at least one layer of a negative image providing monodispersed silver halide photographic emulsion comprising substantially surface latent image type monodispersed silver halide grains, wherein the average grain size of the silver halide grains is 0.7 micron or less, with the silver halide photographic emulsion containing a binder in an amount of 250 g or less per mol of silver halide, and at least one hydrographic colloid layer containing a compound represented by the following general formula (I):

$$R^1NHNHCOR \quad (I)$$

wherein $R^1$ represents an aryl group and $R^2$ represents a hydrogen atom, a phenyl group or an unsubstituted alkyl group having 1 to 3 carbon atoms, in the presence of a compound represented by the following general formula (II) or (III), said compound of the general formula (II) or (III) being in the light-sensitive material, a developer solution or in a processing bath used after exposure but prior to development

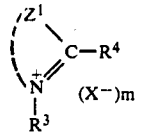

(II)

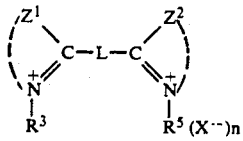

(III)

wherein $Z^1$ and $Z^2$, which may be the same or different, each represents an atomic group necessary to complete a thiazole ring or a selenazole ring; $R^3$ and $R^5$, which may be the same or different, each represents an alkyl group or an alkenyl group; $R^4$ represents a hydrogen atom or an alkyl group; and $R^3$ and $R^4$ may combine to form a ring; L represents a sulfur atom or a divalent hydrocarbon group having 1 to 12 carbon atoms; $X^-$ represents an acid anion; m represents 0 or 1; n represents 0, 1 or 2 and when an inner salt or inner salts are formed m represents 0 or n represents 0 or 1.

2. The process for forming a photographic image as claimed in claim 1, wherein the aryl group represented by $R^1$ is a monocyclic or bicyclic aryl group.

3. The process for forming a photographic image as claimed in claim 1, wherein the compound represented by the general formula (II) is a compound represented by the general formula (IIa).

wherein W represents a sulfur atom or a selenium atom; $R^3$, $R^4$ and $X^-$ each has the same meaning as in the general formula (II); $R^6$ and $R^7$, which may be the same or different, each represents a hydrogen atom, a halogen atom, a nitro group, a cyano group, a sulfo group, a carboxy group, an alkoxycarbonyl group having 2 to 18 carbon atoms, an acyl group having 2 to 18 carbon atoms, an alkyl group having 1 to 18 carbon atoms, an alkoxy group having 1 to 18 carbon atoms, an alkylthio group having 1 to 18 carbon atoms, an acylamino group having 2 to 18 carbon atoms, a hydroxy group, a phenyl group or an aralkyl group having 7 to 12 carbon atoms, and wherein $R^6$ and $R^7$ may combine and form a ring.

4. The process for forming a photographic image as claimed in claim 1, wherein the compound represented by the general formula (I) is a compound represented by the general formula (Ia).

$$R^1NHNHCHO \quad \text{(Ia)}$$

wherein $R^1$ represents an aryl group.

5. The process for forming a photographic image as claimed in claim 4, wherein the compound represented by the general formula (Ia) is a compound represented by the general formula (Ib).

$$R^{11}NHNHCHO \quad \text{(Ib)}$$

wherein $R^{11}$ represents an unsubstituted phenyl group or a tolyl group.

6. The process for forming a photographic image as claimed in claim 1, wherein the average grain size of said silver halide grains is 0.4 micron or less.

7. The process for forming a photographic image as claimed in claim 1, wherein the silver halide emulsion is a sulfur-sensitized silver halide emulsion.

8. The process for forming a photographic image as claimed in claim 1, wherein the photographic light-sensitive material is developed with a developer solution having a pH of about 11 to about 12.3.

9. The process for forming a photographic image as claimed in claim 1, wherein the compound represented by the general formula (I) is present in said negative image silver halide photographic emulsion.

10. The process for forming a photographic image as claimed in claim 1, wherein the compound represented by the general formula (I) and the compound represented by the general formula (II) or (III) are present in said negative image silver halide photographic emulsion.

11. The process for forming a photographic image as claimed in claim 1, wherein a compound represented by the general formula (II) is used, but a compound of the formula (III) is not used.

12. The process for forming a photographic image as claimed in claim 1, wherein $R^2$ is a hydrogen atom, a methyl group, an unsubstituted phenyl group or a phenyl group which is substituted with one or more substituents which are electron attracting groups.

13. The process for forming a photographic image as claimed in claim 11, wherein $R^2$ is a hydrogen atom, a methyl group, an unsubstituted phenyl group or a phenyl group which is substituted with a halogen atom, a cyano group, a trifluoromethyl group, a carboxyl group or a sulfo group.

* * * * *